US010608374B2

(12) United States Patent
Spincich et al.

(10) Patent No.: US 10,608,374 B2
(45) Date of Patent: Mar. 31, 2020

(54) CONNECTOR FOR A DIESEL ENGINE GLOW PLUG

(71) Applicant: TE Connectivity Italia Distribution S.r.l., Turin (IT)

(72) Inventors: Demis Spincich, Turin (IT); Alessandro Genta, Alpignano (IT)

(73) Assignee: TE Connectivity Italia Distribution S.r.l., Turin (IT)

( * ) Notice: Subject to any disclaimer, the term of this patent is extended or adjusted under 35 U.S.C. 154(b) by 0 days.

(21) Appl. No.: 16/279,251

(22) Filed: Feb. 19, 2019

(65) Prior Publication Data

US 2019/0260162 A1 Aug. 22, 2019

(30) Foreign Application Priority Data

Feb. 20, 2018 (IT) ..... 102018000002881

(51) Int. Cl.

| | |
|---|---|
| ***H01R 4/38*** | (2006.01) |
| ***H01R 13/627*** | (2006.01) |
| ***F02P 19/02*** | (2006.01) |
| ***H01R 13/64*** | (2006.01) |
| ***H01R 13/639*** | (2006.01) |
| *H01R 13/04* | (2006.01) |
| *H01R 13/11* | (2006.01) |
| *H01R 13/641* | (2006.01) |

(52) U.S. Cl.

CPC ..... *H01R 13/6275* (2013.01); *F02P 19/021* (2013.01); *H01R 13/639* (2013.01); *H01R 13/64* (2013.01); *F02D 2400/22* (2013.01); *H01R 13/04* (2013.01); *H01R 13/111* (2013.01); *H01R 13/6277* (2013.01); *H01R 13/641* (2013.01)

(58) Field of Classification Search

CPC ..... H01R 13/2673
USPC ..... 439/352
See application file for complete search history.

(56) References Cited

U.S. PATENT DOCUMENTS 2,877,437 A * 3/1959 Flanagan, Jr. ..... H01R 13/6277 439/353
4,017,139 A * 4/1977 Nelson ..... F16L 37/133 439/352
4,919,627 A * 4/1990 Cable ..... H01R 39/64 439/180

(Continued)

OTHER PUBLICATIONS

Italian Search Report, Appl No. IT 2018000002881, dated Oct. 16, 2018, 10 pages.

*Primary Examiner* — Neil Abrams
(74) *Attorney, Agent, or Firm* — Barley Snyder

(57) ABSTRACT

A connector for connecting an electrical conductor to a glow plug of a diesel engine comprises an electrical receptacle terminal, a housing capable of receiving a terminal portion of the glow plug, and a bushing slidably mounted around the housing by engagement of a longitudinal guide rib disposed on an outer surface of the housing in a longitudinal guide groove disposed on an inner surface of the bushing. The housing has a substantially cylindrical tubular body containing the electrical receptacle terminal with an end opening defined by a pair of elastically deformable axial arms capable of engaging the terminal portion. The bushing is movable with respect to the housing from a pre-locking position to a locking position only when the housing is in a correctly mounted position on the terminal portion.

11 Claims, 7 Drawing Sheets

(56) References Cited

U.S. PATENT DOCUMENTS

| | | | | |
|---|---|---|---|---|
| 5,595,499 | A * | 1/1997 | Zander | H01R 13/6277 439/352 |
| 5,637,010 | A * | 6/1997 | Jost | H01R 13/6277 439/352 |
| 6,193,528 | B1 | 2/2001 | Rea et al. | |
| 2006/0223354 | A1 | 10/2006 | Hafele et al. | |
| 2010/0105235 | A1 | 4/2010 | Friedrich et al. | |

* cited by examiner

CONNECTOR FOR A DIESEL ENGINE GLOW PLUG

CROSS-REFERENCE TO RELATED APPLICATION

This application claims the benefit of the filing date under 35 U.S.C. § 119(a)-(d) of Italian Patent Application No. 102018000002881, filed on Feb. 20, 2018.

FIELD OF THE INVENTION

The present invention relates to a connector and, more particularly, to a connector for connecting an electrical conductor to a glow plug of a diesel engine.

BACKGROUND

A connector for connecting an electrical conductor to a glow plug of a diesel engine is disclosed in U.S. Patent Application Publication No. 2006/0223354 A1. The connector has a housing with an electrical contact that is capable of receiving a terminal portion of a glow plug. The connector has a complex construction that results in large dimensions given the limited space generally available for access to the glow plug.

SUMMARY

A connector for connecting an electrical conductor to a glow plug of a diesel engine comprises an electrical receptacle terminal, a housing capable of receiving a terminal portion of the glow plug, and a bushing slidably mounted around the housing by engagement of a longitudinal guide rib disposed on an outer surface of the housing in a longitudinal guide groove disposed on an inner surface of the bushing. The housing has a substantially cylindrical tubular body containing the electrical receptacle terminal with an end opening defined by a pair of elastically deformable axial arms capable of engaging the terminal portion. The bushing is movable with respect to the housing from a pre-locking position to a locking position only when the housing is in a correctly mounted position on the terminal portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
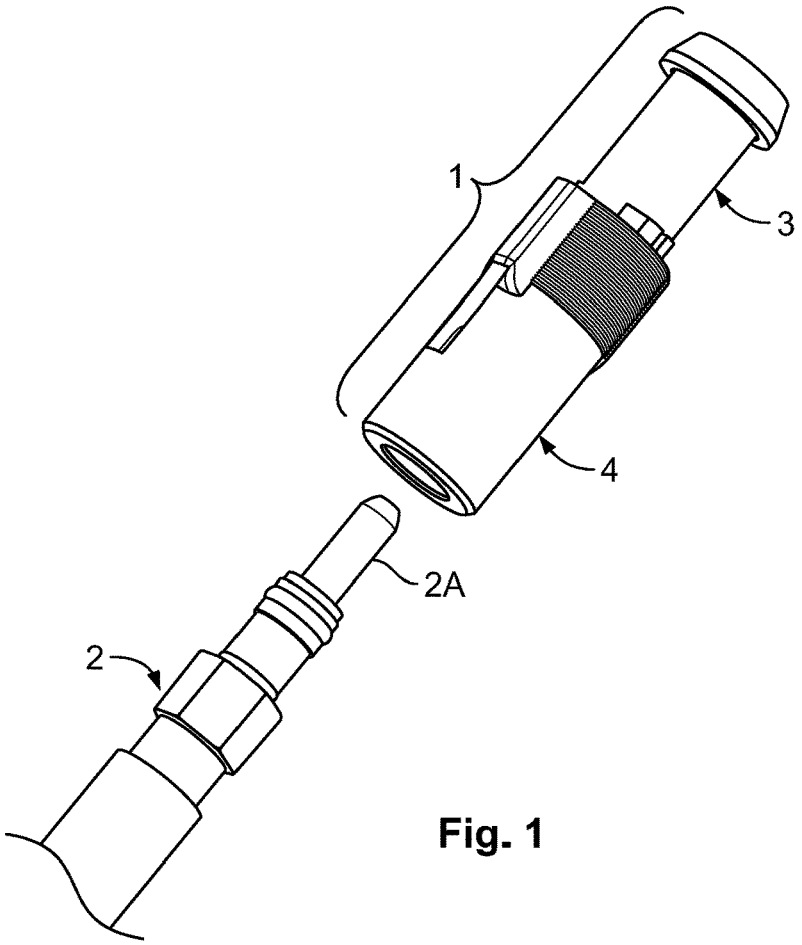
FIG. 1 is a perspective view of a connector according to an embodiment and a terminal portion of a glow plug prior to insertion of the terminal portion.
Figure 2:
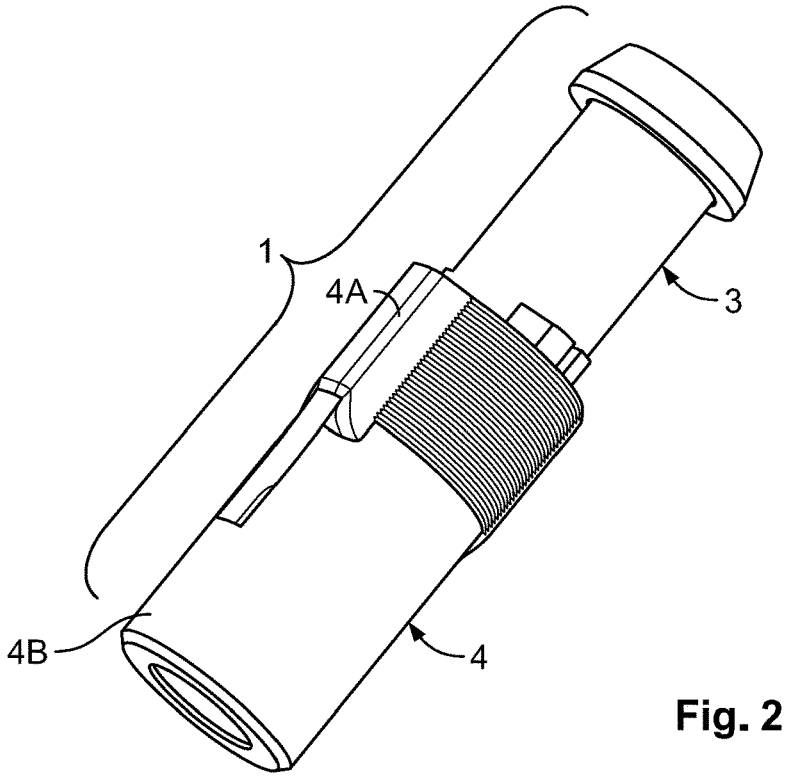
FIG. 2 is a perspective view of the connector of FIG. 1 with a connector position assurance device in a pre-locking position on a housing.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

A connector 1 according to an embodiment for connecting an electrical conductor to a terminal portion 2 of a glow plug of a diesel engine is shown in FIG. 1. The connector 1 comprises a housing 3 and a connector position assurance (CPA) device 4.

Figure 4:
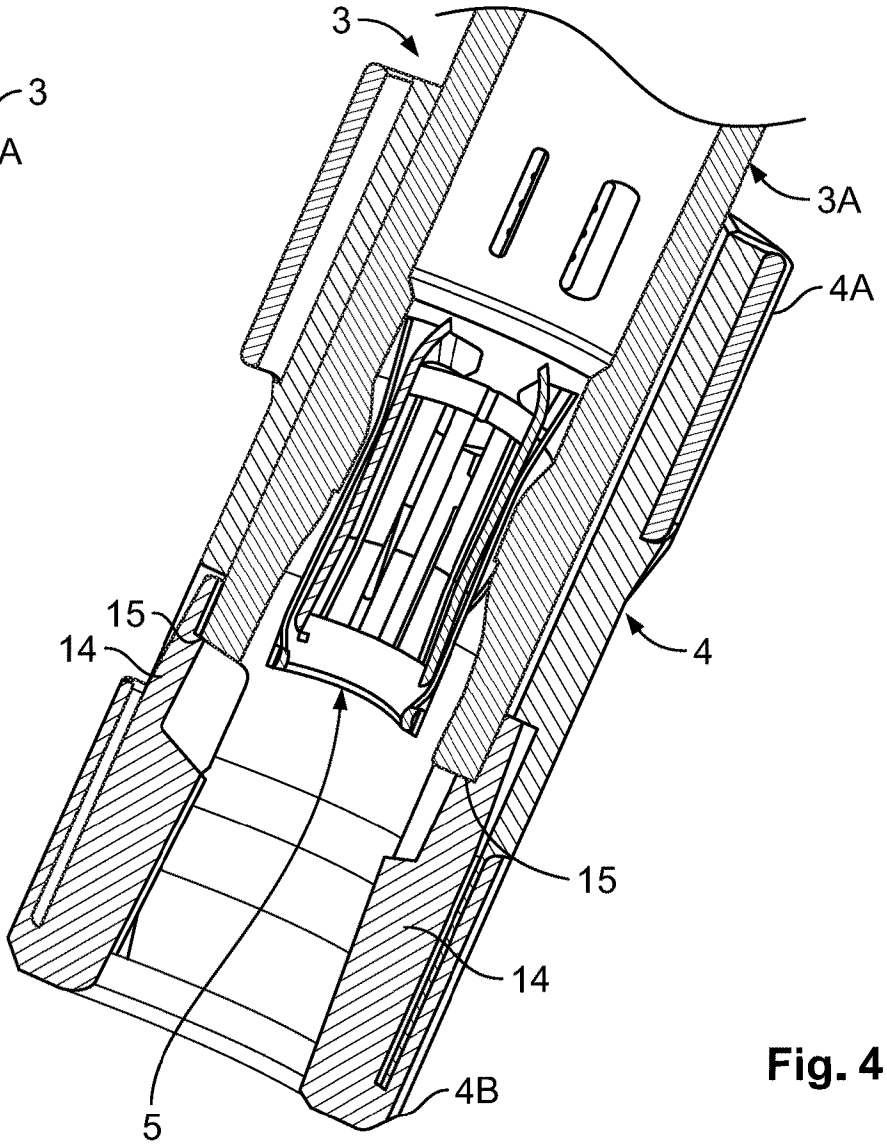
FIG. 4 is another sectional perspective view of the connector of FIG. 2.
Figure 3:
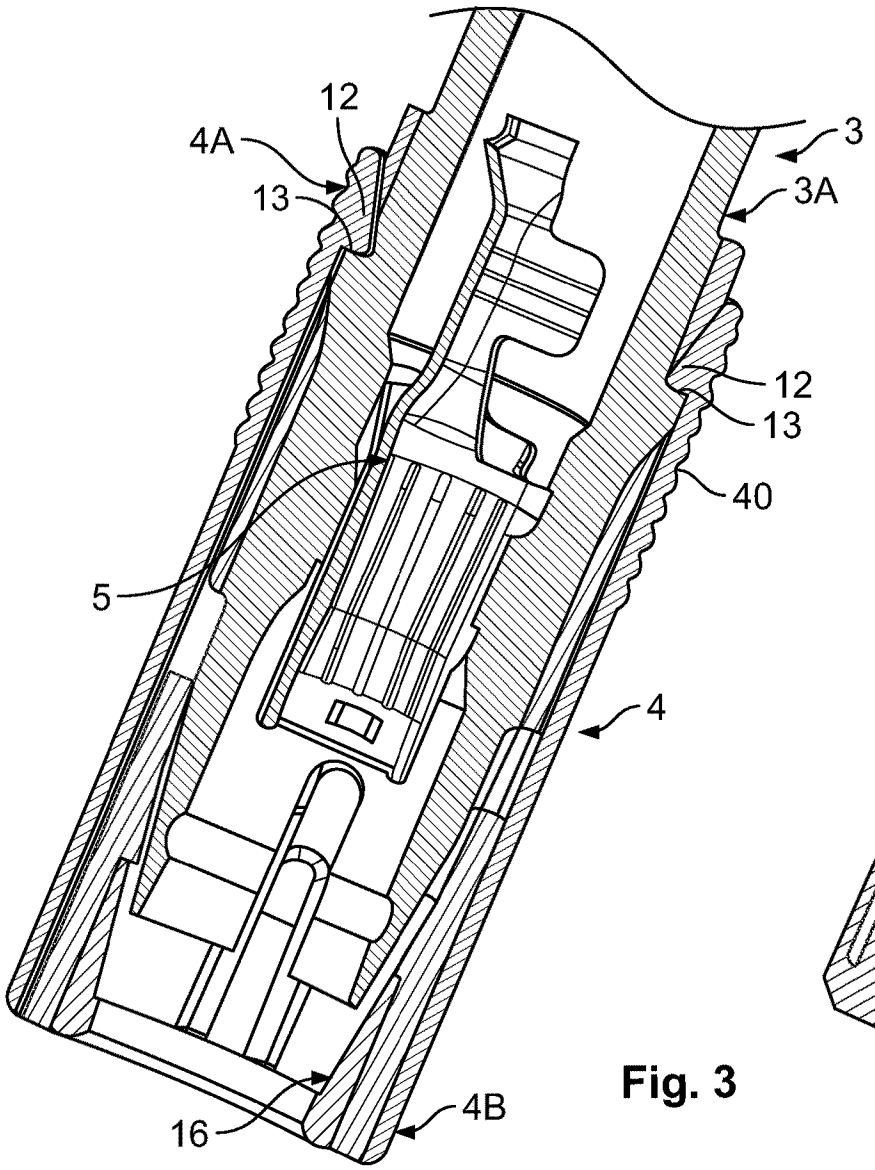
FIG. 3 is a sectional perspective view of the connector of FIG. 2.
Figure 8:
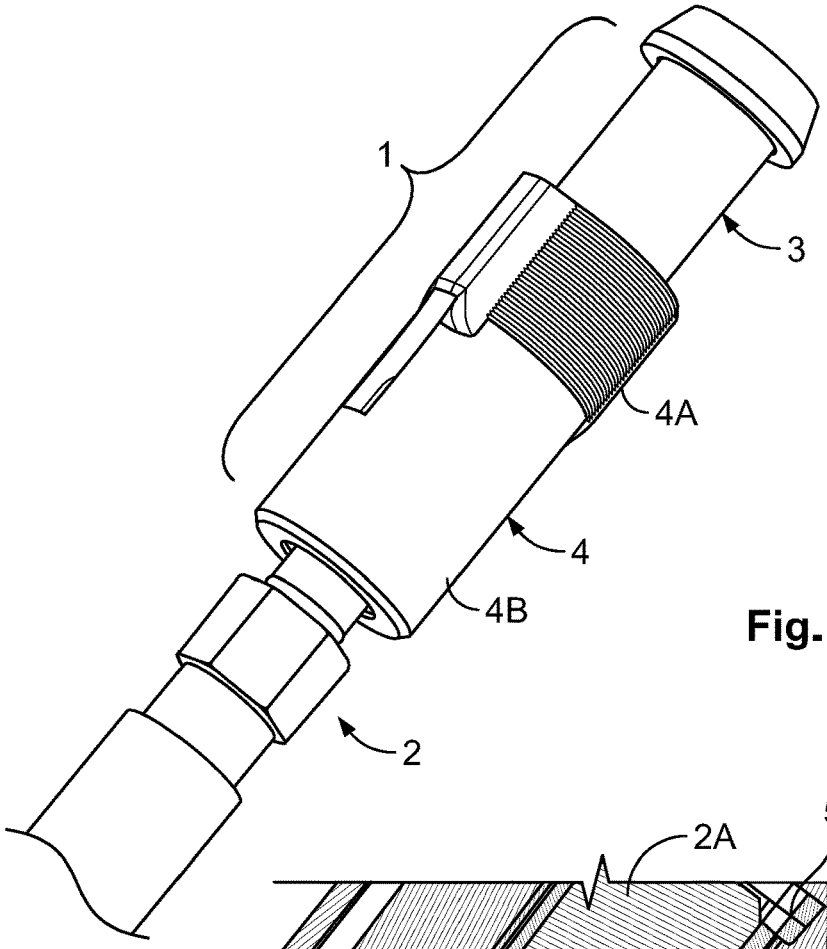
FIG. 8 is a perspective view of the connector mounted on the terminal portion of the glow plug with the connector position assurance device in a final locking position.
Figure 10:
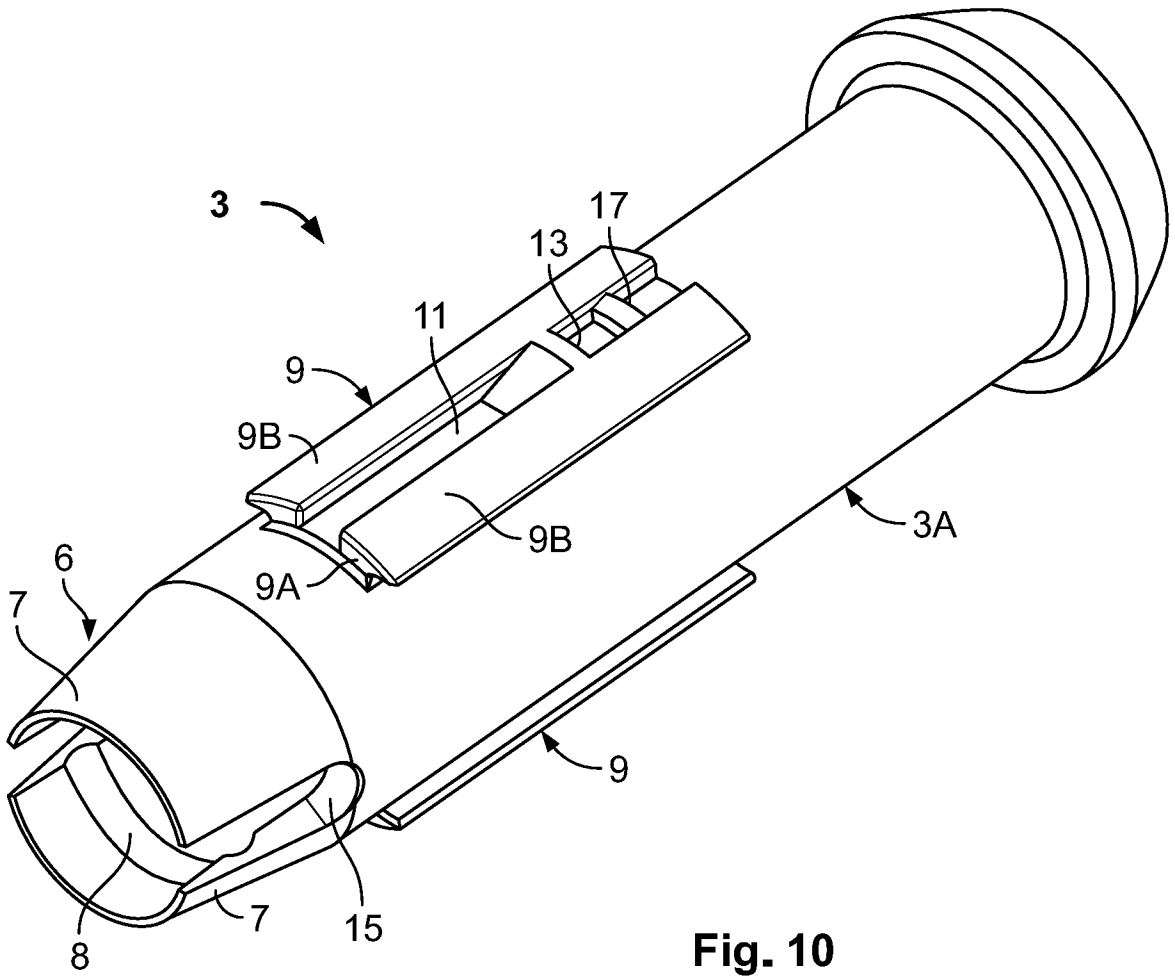
FIG. 10 is a perspective view of a housing of the connector.

The housing 3, as shown in FIGS. 3, 4, and 10, has a cylindrical tubular body 3A. In an embodiment, the cylindrical tubular body 3A is made of a plastic material. The tubular body 3A contains an electrical receptacle terminal 5, as shown in FIGS. 3 and 4. In an embodiment, the electrical receptacle terminal 5 is a sheared and bent sheet metal element. The electrical receptacle terminal 5 is adapted to be electrically connected to an electrical conductor. With the connector 1 mounted on the terminal portion 2 of the glow plug, as shown in FIG. 8, the electrical receptacle terminal 5 of the housing 3 receives an electrical plug terminal 2A shown in FIG. 1 projecting from terminal portion 2 of the glow plug.

The tubular body 3A of housing 3, as shown in FIG. 10, has an end opening 6 defined by a pair of axial arms 7 which are elastically deformable to engage terminal portion 2 of the glow plug. In the shown embodiment, the end opening 6 is defined by two arms 7 diametrically opposite each other, in another embodiment, the end opening 6 may be defined by more than two arms 7 angularly equidistant from each other. The arms 7 define a tapered terminal portion of the outer surface of body 3A of housing 3. In the shown embodiment, the inner surface of each arm 7 has a portion of circumferential groove 8 adapted to engage a circumferential rib 2B, shown in FIG. 5, of terminal portion 2 of the glow plug, following elastic deformation of the respective arm 7. In the shown embodiment, the circumferential rib 2B has an arched circumferential profile corresponding to the profile of the portion of circumferential groove 8 provided on the inner surface of each arm 7.

Figure 11:
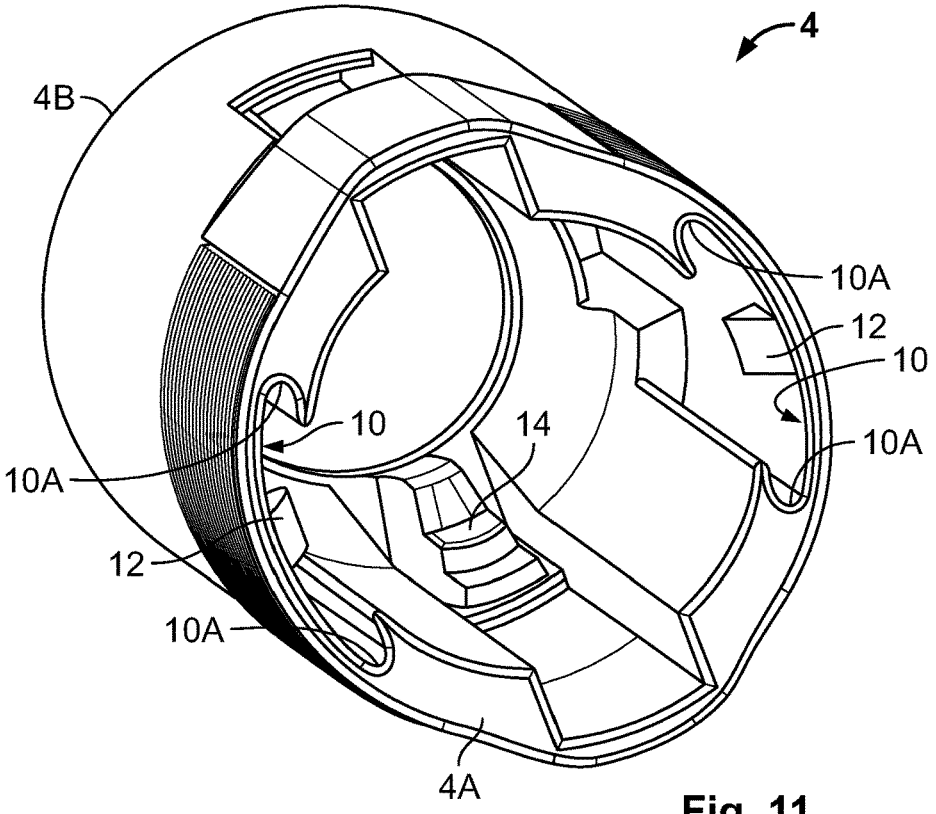
FIG. 11 is a perspective view of the connector position assurance device.
Figure 12:
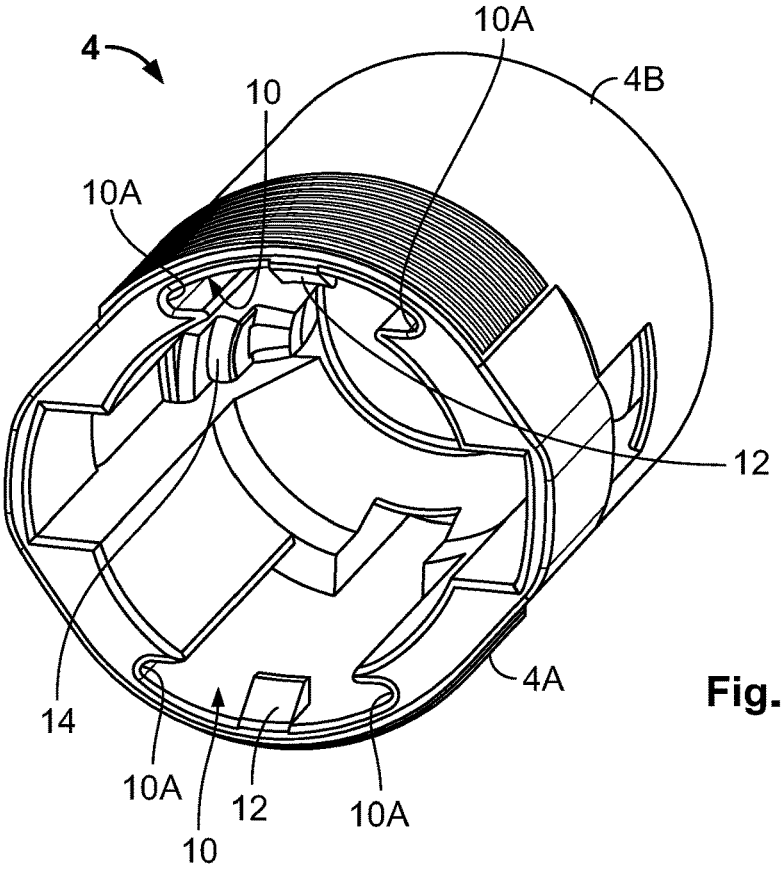
FIG. 12 is another perspective view of the connector position assurance device.

The CPA device 4, as shown in FIGS. 1-4, 11, and 12, is in the form of a cylindrical bushing and is mounted slidably around housing 3. In an embodiment, the CPA device 4 is made of a plastic material. The housing 3 has on its outer surface two diametrically opposed longitudinal guide ribs 9, as shown in FIG. 10, which are slidably received within respective longitudinal guide grooves 10 provided on the inner surface of bushing 4, as shown in FIGS. 11 and 12. In the shown embodiment, two diametrically opposed ribs 9 are disposed on the outer surface of housing 3 and two corresponding grooves 10 are disposed on the inner surface of bushing 4. In another embodiment, a single guide rib 9 and a single corresponding guide groove 10 or even more than two angularly equidistant ribs 9 and a corresponding number of grooves 10 may be used.

Each longitudinal rib 9, as shown in FIG. 10, has a substantially T-shaped profile with a base portion 9A and a head that is wider than base portion 9A defining two lateral arms 9B. Each guide groove 10, as shown in FIGS. 11 and 12, correspondingly has a narrower opening than its bottom surface so as to define two side pockets 10A that receive the two side arms 9B of corresponding rib 9. The shape of rib 9, of course, may vary in other embodiments. Each of longitudinal guide ribs 9 has a longitudinal central groove 11 having a shaped bottom surface.

The CPA device 4, which may also be referred to as a bushing 4, is shaped to be assembled onto the housing 3 before the connector 1 is connected to the glow plug. Bushing 4 is first assembled on housing 3 in a pre-locking position shown in FIGS. 1-5. In this pre-locking position, the bushing 4 acting as the CPA has a first end 4A mounted on housing 3 and a second end 4B projecting axially beyond end opening 6 of housing 3.

As shown in FIGS. 3, 11, and 12, in the pre-locking position of bushing 4 on housing 3, bushing 4 is locked onto housing 3 and cannot be moved axially in either direction. The bushing 4 has a pair of first teeth 12, diametrically opposite each other, projecting from an inner bottom surface of the two guide grooves 10 at the first end 4A. As shown in FIG. 3, in the pre-locking position of bushing 4 on housing 3, the two first teeth 12 engage first contact surfaces 13 of housing 3 defined by the shaped bottom surface of groove 11 shown in FIG. 10. As shown in FIG. 4, the second end 4B of bushing 4 has on its inner surface two diametrically opposed second teeth 14 which are elastically deformable in the radial direction. In the pre-locking condition of bushing 4 on housing 3, the second teeth 14 engage second contact surfaces 15 of housing 3. The second contact surface 15 are defined by the end surfaces of housing 3 separating the two axial arms 7. In the pre-locking position of the CPA bushing 4 on housing 3, engagement of first teeth 12 on first contact surfaces 13 prevents movement of bushing 4 relative to housing 3 in the direction of second end 4B, while engagement of second teeth 14 with second contact surfaces 15 prevents movement of bushing 4 relative to housing 3 in the direction of first end 4A of bushing 4.

Figure 5:
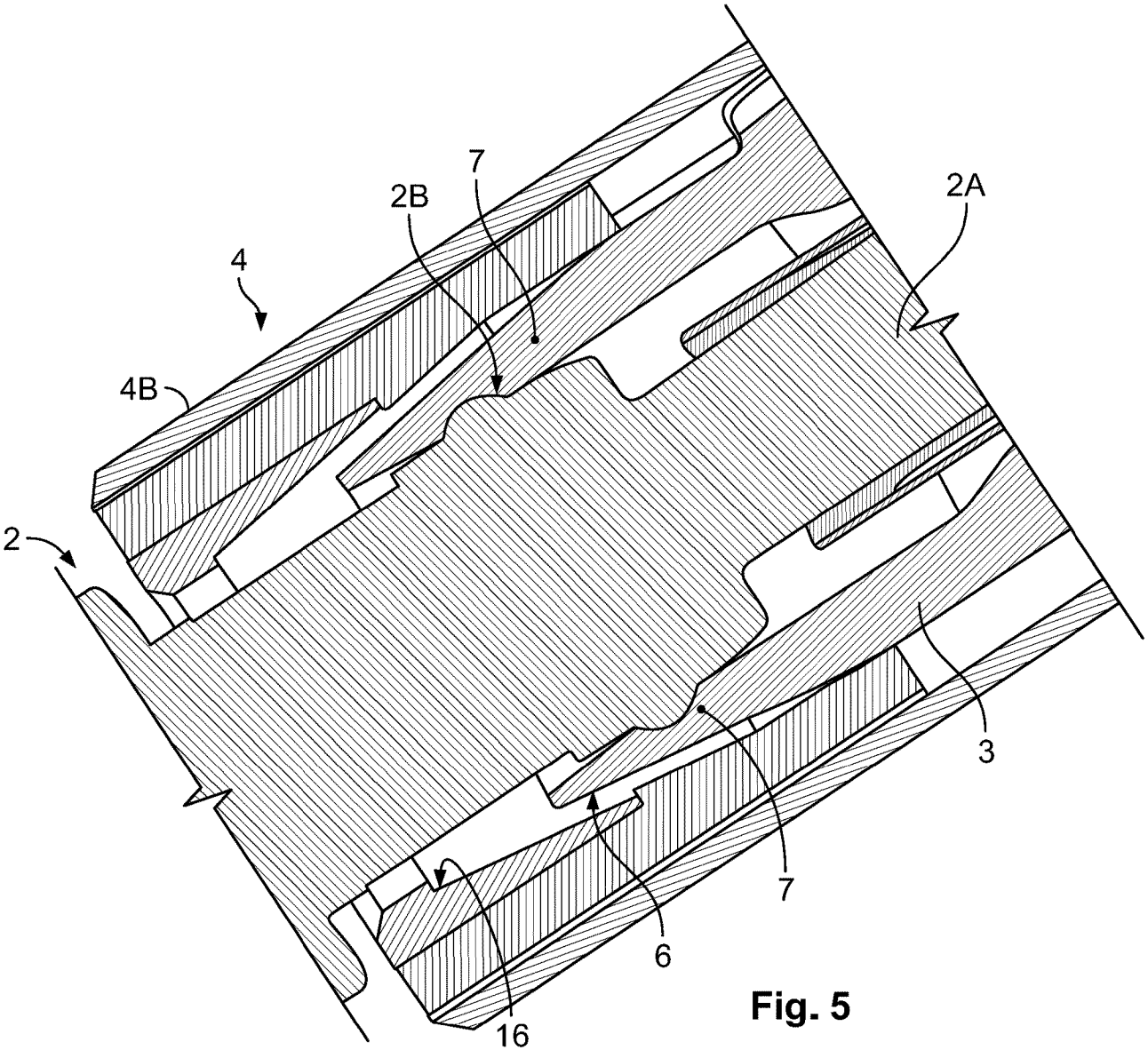
FIG. 5 is a detailed sectional side view of the connector with the housing mounted on the glow plug and the connector position assurance device in the pre-locking position.

As shown in FIGS. 3 and 5, the second end 4B of bushing 4 has an inner surface with a tapered end portion 16. When the bushing 4 is in its pre-locking position on housing 3, tapered portion 16 of the inner surface of bushing 4 is at a distance from the outer surface of the two axial arms 7 of housing 3. The arms 7 are free to deform in a radial direction when the connector 1 is mounted on terminal portion 2 of the glow plug so that axial arms 7 engage the terminal portion 2 and circumferential rib 2B of the glow plug is received within circumferential groove portions 8 of axial arms 7, as shown in FIG. 5.

Figure 6:
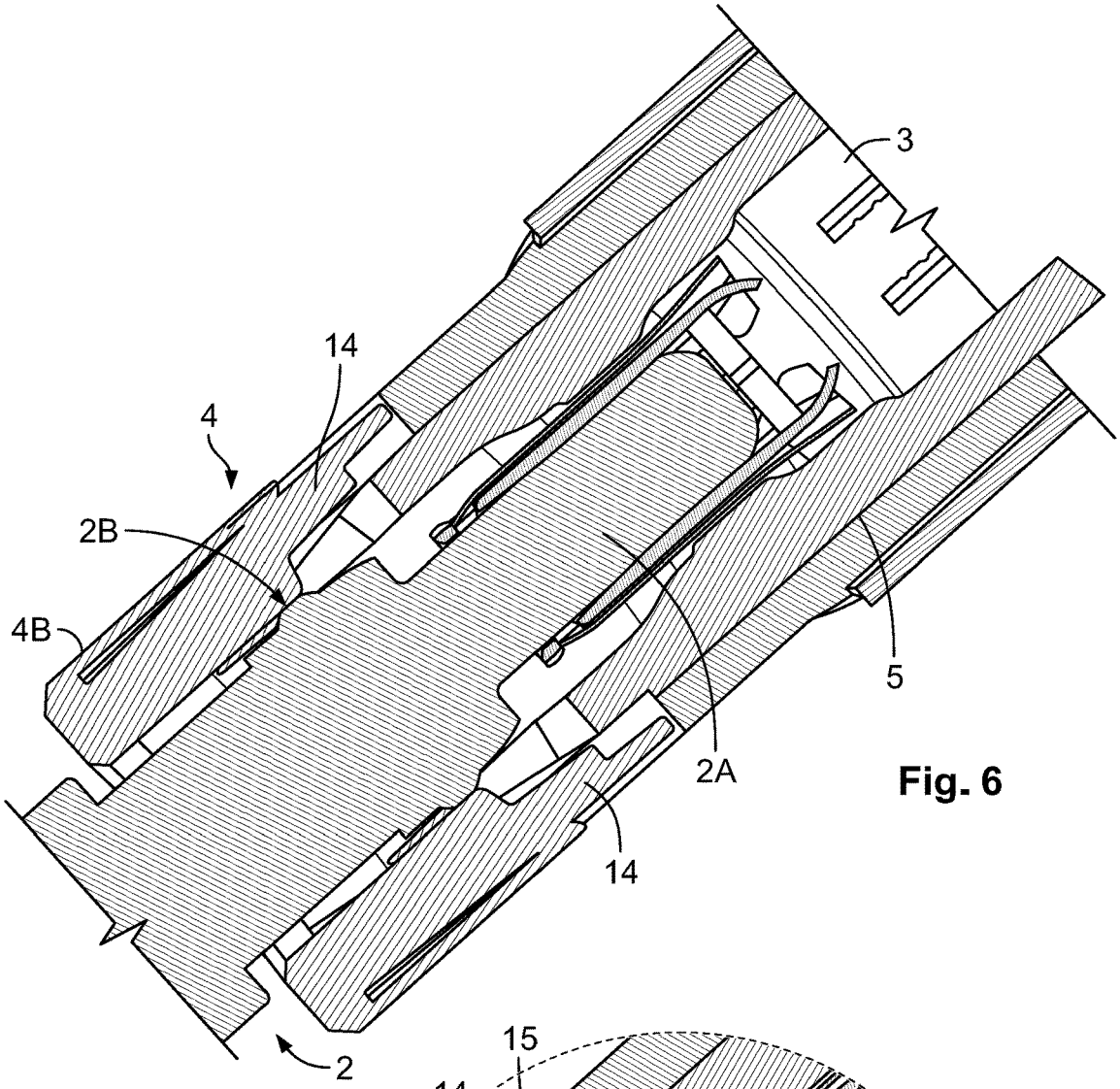
FIG. 6 is another sectional side view of the connector of FIG. 5.
Figure 7:
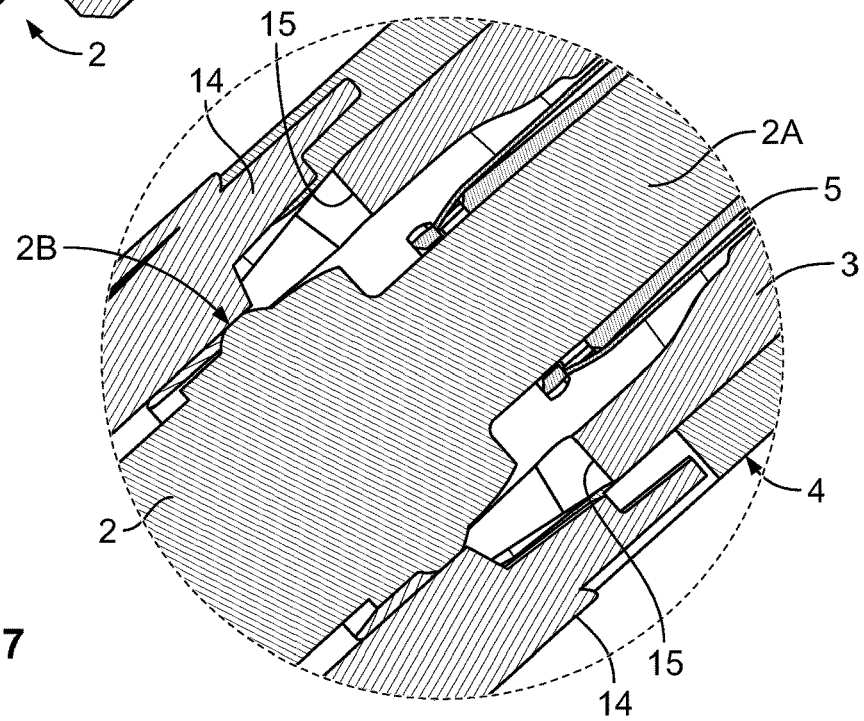
FIG. 7 is a detailed sectional side view of the connector of FIG. 6.

The connector 1, as shown in FIGS. 6 and 7, is mounted on the terminal portion 2 of the glow plug with the plug terminal 2A received within receptacle terminal 5 and the bushing 4 still in the pre-locking position. As shown in FIG. 7, in this condition, the portions of circumferential rib 2B of the glow plug that are not covered by the two arms 7 deform the two second teeth 14 projecting from the inner surface of bushing 4 radially outwards. These second teeth 14 are in fact arranged on opposite sides in the median plane of symmetry of the two arms 7. Second teeth 14 are then moved into a deformed position where they cease to engage second contact surfaces 15 and no longer prevent axial sliding of bushing 4 on housing 3 in the direction of first end 4A of bushing 4. This movement is manually controlled by the user. The outer surface of bushing 4 has a corrugated surface 40 which makes it easier to grip the bushing 4 for manual movement. Displacement of bushing 4 constituting the CPA device from the pre-locking position to the locking position with respect to housing 3 is only possible if housing 3 has been correctly mounted on terminal portion 2 of the glow plug, thus causing second teeth 14 to be deformed by circumferential rib 2B of the glow plug.

Figure 9:
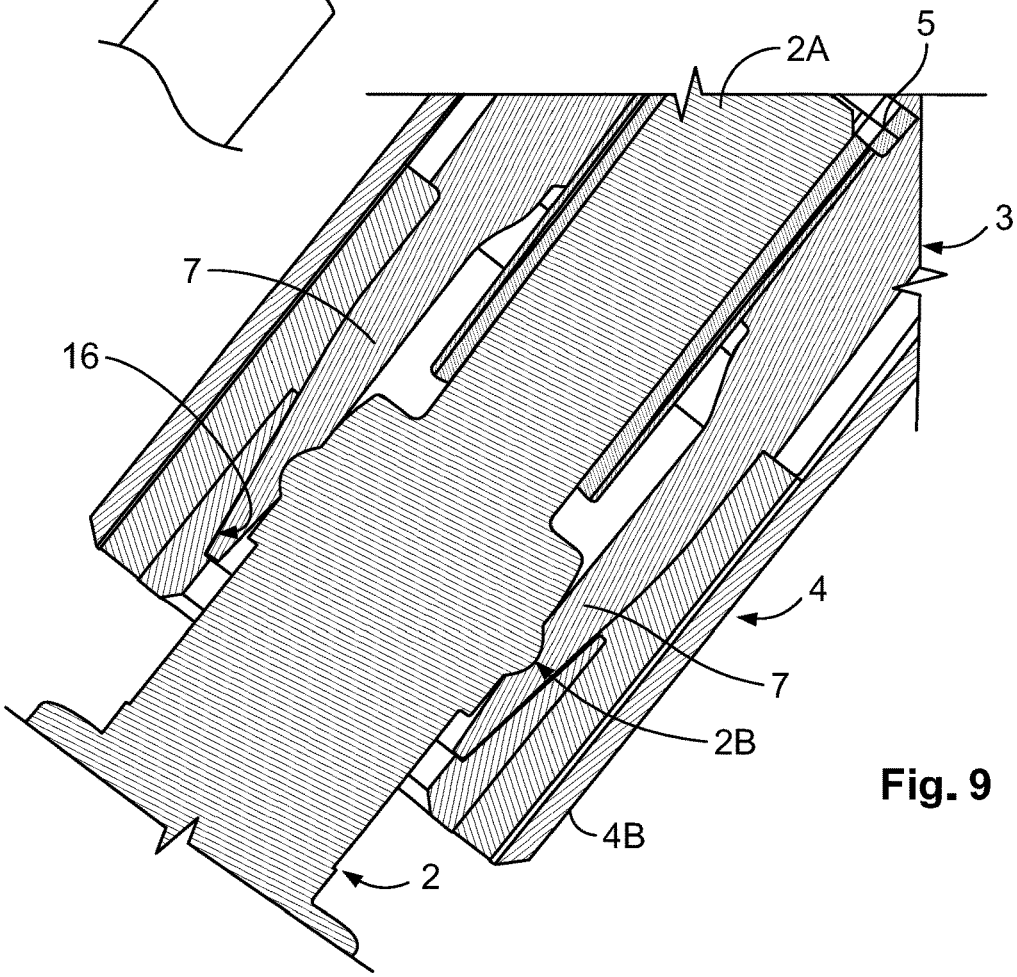
FIG. 9 is a sectional side view of the connector of FIG. 8.

The bushing 4 can thus be moved into a final locking position defined by the engagement of first teeth 12 with respective third contact surfaces 17 defined by the shaped bottom surface of groove 11 arranged centrally along each guide rib 9. In the final locking position, tapered portion 16 of the inner surface of second end 4B of bushing 4 engages the outer surface of arms 7, as shown in FIG. 9, which has a corresponding tapered surface, so as to lock the housing 3 in the position mounted on the glow plug.

The CPA device 4 in the form of a bushing 4 mounted slidably on the housing 3 of connector 1 ensures reliable operation of the connector 1. In addition, the provision of guide ribs 9 on housing 3 and the provision of corresponding guide grooves 10 on the inner surface of bushing 4 makes it possible for the movement of bushing 4 with respect to housing 3 to be correctly and reliably guided and also makes it possible to form contact surfaces 13, 17 on housing 3 without leading to complex shapes and relatively large dimensions for the housing 3. The arrangement of end opening 6 of the housing 3 with axial arms 7 allows end surfaces 15 between said axial arms 7 to be used as additional contact surfaces adapted to cooperate with the CPA bushing 4 to constitute a reference for the pre-locking position of the bushing 4. The additional provision of tapered portion 16 on the inner surface of second end 4B of the bushing 4 provides effective locking of the housing 3 onto the terminal portion 2 of the glow plug in the final locking position of the CPA 4 bushing on the housing 3. At the same time, the bushing 4 leaves arms 7 free to deform to engage the glow plug when the bushing 4 is in its pre-locking position due to the fact that, in this position, bushing 4 has its end 4*b* projecting beyond end opening 16 of the housing 3.

What is claimed is:

1. A connector for connecting an electrical conductor to a glow plug of a diesel engine, comprising:

an electrical receptacle terminal;

a housing capable of receiving a terminal portion of the glow plug, the housing has a substantially cylindrical tubular body containing the electrical receptacle terminal with an end opening defined by a pair of elastically deformable axial arms capable of engaging the terminal portion; and a bushing slidably mounted around the housing by engagement of a longitudinal guide rib disposed on an outer surface of the housing in a longitudinal guide groove disposed on an inner surface of the bushing, the bushing is movable with respect to the housing from a pre-locking position to a locking position only when the housing is in a correctly mounted position on the terminal portion, the bushing is a connector position assurance device configured to be assembled on the housing in the pre-locking position before the connector is connected to the glow plug, in the pre-locking position a first end of the bushing is on the housing and a second end of the bushing projects axially beyond the end opening of the housing and the axial arms are free to deform elastically in a radial direction when the housing is mounted on the terminal portion, the bushing has a first tooth projecting from the inner surface at the first end and engaging a first contact surface of the housing in the pre-locking position to prevent axial movement of the bushing on the housing in a direction of the second end of the bushing, the bushing has a second tooth projecting from the inner surface at the second end and elastically deformable in the radial direction, the second tooth engaging a second contact surface of the housing in the pre-locking position to prevent axial movement of the bushing on the housing in a direction of the first end of the bushing, the second tooth is radially deformed from the terminal portion toward a position disengaged from the second contact surface when the housing is in the correctly mounted position on the terminal portion, the bushing is capable of being moved in the direction of the first end up to the locking position when the connector is in the correctly mounted position on the terminal portion, the first tooth engages a third contact surface of the housing in the locking position, the inner surface of the second end of the bushing has a tapered portion engaging around the axial arms and locking the housing on the terminal portion when the bushing is in the locking position.

2. The connector of claim 1, wherein the longitudinal guide rib has a T-shape profile with a base portion and an enlarged head defining a pair of lateral arms.

3. The connector of claim 2, wherein the longitudinal guide groove has a narrower opening than a bottom wall of the longitudinal guide groove to define a pair of lateral pockets slidably receiving the lateral arms.

4. The connector of claim 1, wherein the longitudinal guide rib has a longitudinal central groove with a shaped bottom surface that defines the first contact surface and the third contact surface.

5. The connector of claim 1, wherein the second contact surface is a portion of the end surface of the housing arranged between the axial arms.

6. The connector of claim 1, wherein the housing has a pair of diametrically opposed longitudinal guide ribs slidably received in a pair of longitudinal guide grooves of the bushing.

7. The connector of claim 6, wherein the bushing has a pair of first teeth disposed diametrically opposite each other and projecting from a bottom surface of the longitudinal guide grooves adjacent the first end of the bushing.

8. The connector of claim 1, wherein the axial arms define a tapered outer surface cooperating with the tapered portion of the bushing in the locking position.

9. The connector of claim 8, wherein an inner surface of each of the axial arms has a circumferential groove receiving a circumferential rib of the terminal portion when the housing is in the correctly mounted position on the terminal portion.

10. The connector of claim 9, wherein the bushing has a pair of diametrically opposed second teeth on the inner surface at the second end.

11. The connector of claim 10, wherein the pair of diametrically opposed second teeth cooperate with the circumferential rib of the terminal portion in an area that is not covered by the axial arms.

* * * * *